US006132346A

United States Patent [19]

Weeks

[11] Patent Number: 6,132,346

[45] Date of Patent: Oct. 17, 2000

[54] FULL MOBILITY RESISTANCE EXERCISE SYSTEM

[76] Inventor: James N. Weeks, 107 Pineneedle La., Greenwood, S.C. 29649

[21] Appl. No.: 09/281,684

[22] Filed: Mar. 30, 1999

Related U.S. Application Data

[60] Provisional application No. 60/079,811, Mar. 30, 1998.

[51] Int. Cl.[7] ..... A63B 21/02

[52] U.S. Cl. ..... 482/124; 482/125

[58] Field of Search ..... 482/124, 125

[56] References Cited

U.S. PATENT DOCUMENTS

| | | | |
|---|---|---|---|
| 1,969,165 | 8/1934 | Turner . | |
| 3,677,543 | 7/1972 | Richardson | 272/82 |
| 3,966,204 | 6/1976 | Dubach | 272/135 |
| 4,059,265 | 11/1977 | Wieder | 272/137 |
| 4,685,671 | 8/1987 | Hagerman | 272/139 |
| 4,733,862 | 3/1988 | Miller | 272/137 |
| 5,137,272 | 8/1992 | Wilkinson | 482/124 |
| 5,308,305 | 5/1994 | Romney | 482/124 |
| 5,372,565 | 12/1994 | Burdenko | 482/124 |
| 5,431,617 | 7/1995 | Rattray, Jr. | 482/129 |
| 5,472,394 | 12/1995 | Michaelson | 482/74 |
| 5,792,034 | 8/1998 | Kozlvosky | 482/124 |

*Primary Examiner*—Michael A. Brown
*Assistant Examiner*—Lori Baker
*Attorney, Agent, or Firm*—John D. Gugliotta

[57] ABSTRACT

A full mobility resistance exercise system including a nylon vest with a posterior surface and worn around a user's chest. The vest utilizes a fastening means for adjustment of size. A rectangular support plate is attached flatly against and included within the posterior surface of the nylon vest. A horizontally elongated, inverted V-shaped rigid member is attached to the support plate on the posterior surface and perpendicular to the plane formed by the support plate. The rigid member extends horizontally outward and behind the user from the posterior surface of the nylon vest. Two pairs of adjustable nylon straps are worn around the user's knees and elbows. A plurality of elastic cables extends from each nylon strap, at the knee or elbow, to the end of the rigid member in a taut position.

3 Claims, 2 Drawing Sheets

FULL MOBILITY RESISTANCE EXERCISE SYSTEM

RELATED APPLICATIONS

This application claims the benefit of U.S. Provisional Ser. No. 60/079,811 filed Mar. 30, 1998.

The present invention is a continuation of Disclosure Document Number 426666 filed on Oct. 8, 1997.

BACKGROUND OF THE INVENTION

1. Field of the Invention

The present invention relates generally to cardiovascular exercise equipment, and, more particularly, to a full mobility resistance exercise system that provides independent resistance training capabilities for each major muscle group in the body.

2. Description of the Related Art

A search of the prior art did not disclose any patents that read directly on the claims of the instant invention; however, the following references were considered related:

U.S. Pat. No. 5,472,394, issued to Kyron C. W. Michaelson

U.S. Pat. No. 5,431,617, issued to Samuel W. Rattray, Jr.

U.S. Pat. No. 5,372,565, issued to Igor Burdenko

U.S. Pat. No. 5,308,305, issued to Jan W. Romney

U.S. Pat. No. 5,137,272, issued to William T. Wilkinson

U.S. Pat. No. 4,733,862, issued to Jack V. Miller

U.S. Pat. No. 4,685,671, issued to Gene R. Hagerman et al.

U.S. Pat. No. 4,245,839, issued to Stanley G. Trent

U.S. Pat. No. 4,059,265, issued to Horst K. Wieder et al.

U.S. Pat. No. 3,966,204, issued to Werner Dubach

U.S. Pat. No. 3,677,543, issued to John H. Richardson

U.S. Pat. No. 1,969,165, issued to Dee Turner

While several features exhibited within these references are incorporated into this invention, alone and in combination with other elements, the present invention is sufficiently different so as to make it distinguishable over the prior art.

SUMMARY OF THE INVENTION

The present invention consists of a nylon vest with a support plate located along the back of the nylon vest. A rigid member of an inverted, V-shaped configuration, extends outward, perpendicular to the surface area of the support plate. Elastic cables attach to the knees and elbows of the user by means of individual nylon straps. The elastic cables extend behind the user and are joined at a common attachment point at the end of the rigid member, opposite the nylon vest. The present invention is designed to travel with the user as he or she walks, jogs, or runs indoors or outdoors. As the user then jogs, runs, or sprints, the elastic cables create a resistance that increases the difficulty to maintain the motion, thus increasing the cardiovascular exertion level. The rigid member keeps the cables positioned away from the body and in proper alignment for exercising purpose. The nylon vest and the nylon straps are easily attached by either a conventional buckle or hook and loop fastening system, such as Velcro. A nylon belt is also envisioned in an alternate embodiment. A series of adjustment holes are located on the bottom of the rigid member, allowing the elastic cables to be adjusted to increase and decrease tension.

It is an object of the present invention to provide a mobile exercise device that travels with the user during walking, jogging or running, and that provides a resistance cardiovascular workout while conditioning and toning the individual appendages of the body, thus facilitating balanced development of muscular strength for users who participate in a wide range of sporting activities.

Descriptive Key

10 full mobility resistance exercise system
20 elastic cable
25 rigid member
27 support plate
30 nylon vest
40 nylon straps
50 common attachment point
60 adjustment hole

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

In order to describe the complete relationship of the invention, it is essential that some description be given to the manner and practice of functional utility and description of a full mobility resistance exercise system 10.

Figure 1:
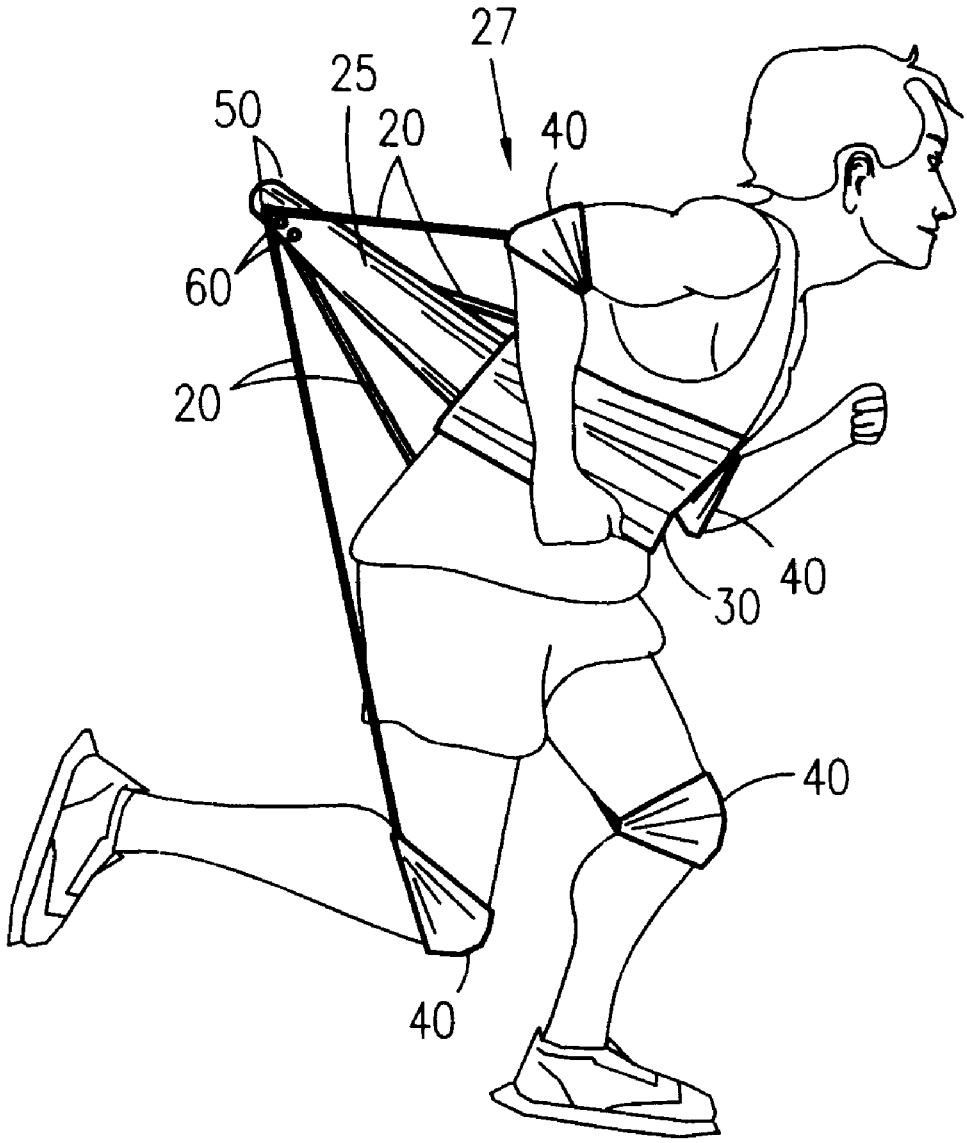
FIG. 1 is a side perspective view of the preferred embodiment of a full mobility resistance exercise system 10.
Figure 2:
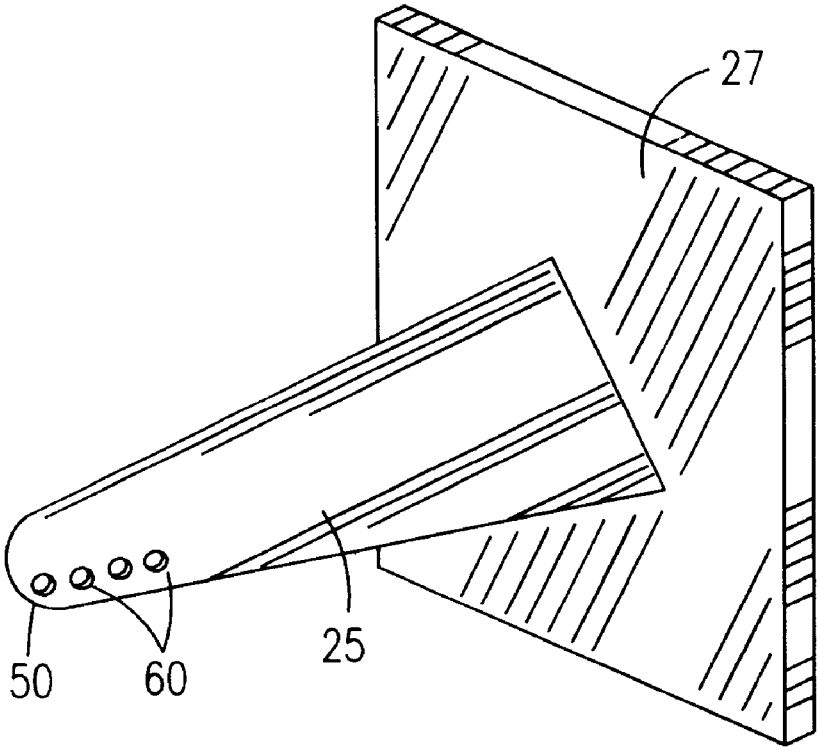
FIG. 2 is a side view of the rigid member and support plate of the preferred embodiment of the present invention.

The best mode for carrying out the invention is presented in terms of its preferred embodiment, herein depicted within the FIGS. 1 and 2.

1. Detailed Description of the Figures

Referring now to FIG. 1, a full mobility resistance exercise system 10 is shown, according to the present invention, designed to provide a full body workout while walking, jogging or running indoors or outdoors, comprising a plurality of elastic cables 20. In the preferred embodiment, four elastic cables 20 are disclosed. Each elastic cable 20 is designed such that as additional elongational force is applied to the elastic cable 20, resistance to further elongation is increased.

It is envisioned that a horizontally elongated, inverted V-shaped, rigid member 25, made from a strong, lightweight material, such as metal or plastic, is attached to a support plate 27 on one end. The support plate 27 is of generally rectangular configuration, and is designed to be incorporated into and lay flat against the posterior surface of a nylon vest 30, which is worn around the waist of the user. The support plate 27 is positioned perpendicular to the elongated centerline formed by the rigid member 25. When the support plate 27 is incorporated into the posterior surface of the nylon vest 30, the rigid member 25 extends horizontally outward and behind the user from the posterior surface of the nylon vest 30. The length of the rigid member 25 is such that during operation of the device, the legs and arms of the user are free to move through a full range of motion without coming into mechanical interference with the elastic cables 20.

The nylon vest 30 is of traditional configuration, with adjustment provided by a conventional buckle or hoop or loop fastening systems, such as Velcro. A nylon belt is also envisioned in an alternate embodiment.

Nylon straps 40 are designed to be worn around the users knees and elbows. The nylon straps 40 are adjustable, utilizing conventional buckle or hoop or loop fastening systems, such as Velcro.

The elastic cables 20 extend from each of these nylon straps 40. All four of the elastic cables 20 extend backward, behind the user, being joined at a common attachment point 50, located at the end of the rigid member 25, opposite the nylon vest 30. The length of each of the elastic cables 20 is such that in the resting position, each elastic cable 20 extends, taut, from its respective body part to the common attachment point 50 behind the user.

A plurality of adjustment holes 60 are incorporated into the lower surface of the rigid member 25, opposite the support member 27, thus allowing the user to adjust the tension of the elastic cables 20.

It is envisioned that other styles, configurations, and materials of the rigid member 25 and support plate 27 can be easily incorporated into the teachings of the present invention, and only one particular configuration shall be shown and described for purposes of clarity and disclosure and not by way of limitation of scope.

2. Operation of the Preferred Embodiment

To use the present invention, the operator chooses the adjustment hole 60 he or she wishes to attach the elastic cables 20 to, depending on the resistance desired. The operator then places the nylon vest 30 on his or her chest in the traditional manner, adjusting the fit as necessary. The operator then places the nylon straps 40 around his or her elbows and knees, adjusting the fit to a desired tightness. The operator then walks, jogs or runs, either in place or on a running track, sidewalk, etc. The elastic cables 20 provide resistance to the body members as the user walks, jogs or runs. By utilizing individual elastic cables 20, each appendage receives isolated tension and the user receives a full body workout, with the muscular strength of each pair of appendages being developed evenly.

The foregoing description is included to illustrate the operation of the preferred embodiment and is not meant to limit the scope of the invention. The scope of the invention is to be limited only by the following claims.

What is claimed is:

1. A full mobility resistance exercise system comprising:

a nylon vest, said nylon vest having a posterior surface and worn around a users chest, said nylon vest having a fastening means for adjustment of size;

a rectangular support plate attached flatly against and included within the posterior surface of said nylon vest;

a horizontally elongated, inverted V-shaped rigid member, said rigid member attached to said support plate on the posterior surface, said rigid member centerline perpendicular to the plane formed by said support plate, said rigid member extending horizontally outward and behind the user from said posterior surface of said nylon vest;

two pair of nylon straps provided to be worn around the users knees and elbows, said nylon straps having adjustable means; and a plurality of elastic cables extending from each nylon strap, each said elastic cable extending from the knee or elbow to the end of the rigid member in a taut position.

2. The fill mobility resistance exercise system described in claim 1, wherein the length of said rigid member extends to a point where during operation the legs and arms of the user are free to move through a fall range of motion without coming into mechanical interference from said elastic cables.

3. The full mobility resistance exercise system described in claim 1, wherein said rigid member comprises a plurality of adjustment holes, said adjustment holes included within the lower surface of said rigid member allowing the user to adjust the tension of said elastic cables.

* * * * *